United States Patent [19]

Helle et al.

[11] 4,160,707

[45] Jul. 10, 1979

[54] PROCESS FOR APPLYING COATINGS CONTAINING BOTH A METAL AND A SYNTHETIC RESIN

[75] Inventors: Kees Helle, Bennekom; Andries Kamp, Zevenaar, both of Netherlands

[73] Assignee: Akzo N.V., Arnhem, Netherlands

[21] Appl. No.: 780,051

[22] Filed: Mar. 22, 1977

[30] Foreign Application Priority Data

Apr. 26, 1976 [NL] Netherlands ..... 7604399

[51] Int. Cl.[2] ..... C25D 3/02; C25D 5/10; C25D 5/50

[52] U.S. Cl. ..... 204/37 R; 204/40; 204/41; 204/48; 204/49; 204/52 R; 204/55 R

[58] Field of Search ..... 204/16, 37 R, 40, 41, 204/48, 49, 52 R, 55 R

[56] References Cited

U.S. PATENT DOCUMENTS

| | | | |
|---|---|---|---|
| 3,356,467 | 12/1967 | Brown et al. | 204/41 |
| 3,672,970 | 6/1972 | Tomaszewski | 204/52 R |
| 3,687,824 | 8/1972 | Brown et al. | 204/40 |

FOREIGN PATENT DOCUMENTS 1366823 9/1974 United Kingdom.

*Primary Examiner*—T. Tung
*Assistant Examiner*—William Leader
*Attorney, Agent, or Firm*—Stevens, Davis, Miller & Mosher

[57] ABSTRACT

A process is provided for simultaneously coating an article with a metal and a synthetic resin. In this process, the article to be coated is made the cathode in an aqueous electroplating bath. The electroplating bath contains (1) a metal salt, (2) particles of a synthetic resin in a concentration of about 3 to about 250 grams per liter of bath, (3) a cationic surfactant and (4) a nonionic surfactant. The concentration of the resin particles in the bath is from about 3 to about 250 grams per liter and the particle size of the resin is less than about 10 micrometers. The cationic and nonionic surfactants are used in a ratio of between 100:1 and 2:1 and the concentration of the two surfactants in the bath is at least $4\times10^{-3}$ mmoles per $m^2$ of surface area of the particles. The bath is subjected to electrolysis until a coating of a metal and the resin forms on the surface of the article. A resinous coating is deposited over the layer of metal and resin. The process is applicable to resinous compounds which do not contain fluorocarbon groups. The surfactants are those which are of the non-fluorocarbon type.

17 Claims, No Drawings

PROCESS FOR APPLYING COATINGS CONTAINING BOTH A METAL AND A SYNTHETIC RESIN

This invention relates to a process for providing an object with a coating formed by a resin which is not a polyfluorocarbon compound and, if desired, by particles of a different material, and to articles which are entirely or partially provided with a coating thus applied.

By a resin which is not a polyfluorocarbon compound is to be understood a hydrocarbon resin which beside hydrogen and carbon may contain atoms of different elements like nitrogen, sulphur, phosphorus and/or oxygen, and no completely fluoridized carbon atoms.

Coatings which contain resins are generally known. It is also known that depositing a coating onto a metal article from an electroplating bath results in a better, and particularly, a more homogeneous surface than when the coating is applied to the article in a different way. For example, in order to avoid immediate corrosion of for instance an iron substrate when a coating or paintlayer is damaged, the substrate should be subjected to a phosphatizing treatment prior to the application of the coating composition.

The present invention provides a process by which a substrate to be coated can be given both cathodic protection and a protective coating in a single treatment.

The process provided by the invention is characterized in that from an electroplating bath there are codeposited onto an object serving as a cathode, a metal and resin particles which are not of the fluorocarbon type and have an average particle size of less than about 10 μm. The concentration of the resin particles in the bath is about 3 to 250 g per liter of bath liquid. The bath contains both a cationic and a nonionic surface active compound, which are not of the fluorocarbon type, in a molar ratio between about 100:1 and 2:1 and in an amount which is at least $4\times10^{-3}$ mmoles per $m^2$ of the surface area of the particles. The resulting coating, after drying, is optionally subjected to curing and/or sintering and/or melting.

By a surfactant which is of the non-fluorocarbon type is to be understood a hydrocarbon surfactant which beside hydrogen and carbon may contain atoms of different elements like nitrogen, sulphur, phosphorus and/or oxygen, and no completely fluoridized carbon atoms.

It should be added that the codeposition from an electroplating bath onto an object serving as a cathode of a metal and resin particles having an average particle size of less than 10 μm in the presence of both a cationic and a nonionic surface active compound is known in itself from the Netherlands Patent Application No. 7,203,718.

In Example V of the Netherlands patent application, a polyester powder and a metal are codeposited from an electroplating bath onto an object acting as a cathode. The cationic wetting agent used in that case, however, is of the fluorocarbon type. Moreover, the molar ratio between the two types of wetting agents does not satisfy the requirements which must be met in order to attain the object now envisaged.

In one of its sub-claims British patent specification No. 1,366,823, too, mentions the possibility of using a nonionic wetting agent. In the description and in the examples, however, no mention is made at all of this use, so it is not apparent that the amount to be used and the molar ratio between the two types of surface active compound could be derived from it.

The use of the process according to the invention leads to coatings of extraordinarily high quality. Following a sintering treatment the metal deposited along with the resin particles is completely covered by a homogeneous layer, which may have been impregnated, if desired, with some material prior to the sintering treatment. This implies that a surface thus treated no longer need be provided with a top coating. So it is possible in one treatment to apply both a prime coating and a top coating. Cathodic protection can be obtained by choosing a metal, such as zinc, as the metal component of the coating, as a result of which the substrate, of, say iron, will be protected from corrosion in the case of damage to the sintered layer.

The invention also provides a method of applying the composite metal coatings in such a way that there is no longer any chance of flocculation of the particles suspended in the electroplating bath over a period of time. It is true that such flocculation may be counteracted by continuous agitation of the bath, but after some time it will still be necessary to re-disperse the particles. This drawback will be even more manifest if the bath is used at long intervals. Such a situation will be encountered for instance in electroplating plants where the required metal component of the composite coatings to be applied continually varies, so that a large number of baths containing such particles must constantly be kept ready for use. It has further been found that a number of metals, such as lead, are difficult to incorporate into a composite coating by using the prior art method.

The present invention provides a process by which the drawbacks to the prior art method of applying composite metal coatings are largely obviated. The invention provides an improvement over the known methods discussed above wherein an object acting as a cathode is coated with a metal and particles of a resin which have an average diameter of less than about 10 μm codeposited from an electroplating bath containing the resin particles in a concentration of about 3 to 250 grams per liter of bath liquid in the presence of both a cationic and a nonionic surface active compound which are not of the fluorocarbon type, in a molar ratio between 100:1 and 2:1 and in an amount which is at least $4\times10^{-3}$ mmoles per $m^2$ of surface area of the resin particles, and onto the resulting coating serving as a cathode there is subsequently deposited a metal from an electroplating bath of a different composition and, if desired, particles of a different material. Irrespective of the number of metals to be incorporated into the coating, the process according to the invention may in principle be carried out with only one electroplating bath containing a suspension of resin particles. A nickel sulphamate or Watt's nickel bath containing a suspension of resin particles may be used.

If a composite metal coating containing a metal other than nickel is required, the object to be coated, after a first treatment in a nickel bath containing resin particles, is placed in an electroplating bath in which a salt of the other metal is dissolved. Subsequently, the object is connected to the negative pole and the electrolysis is carried out until the porous and conductive layer formed in the first electrolysis is entirely or partly filled up with the metal used, depending on the required thickness of the composite coating. The part of the porous layer that is not filled up can easily be removed from the object after it has been taken out of the electroplating bath. The process, according to the invention, makes it possible to produce resin- and metal-containing coatings in a technologically simple and economically attractive manner.

The invention contemplates any number of metals to be incorporated into the coating and can be used to deposit as many metals as can be deposited from the conventional electroplating bath. As examples of suitable metals may be mentioned: silver, iron, lead, nickel, cobalt, gold, copper, zinc, metal alloys such as bronze, brass, etc.

The present process also offers great advantages in the case where the two electroplating baths are nickel baths, particularly because of the high speed at which the coating operation can be performed. In the process according to the invention the second electroplating bath may contain a suspension of particles of another material besides or instead of a metal salt. The charge of the dispersed particles should be positive. The average particles size should certainly not exceed 10 $\mu$m and should preferably be smaller.

The other particles that may be deposited from an electroplating bath of a different composition may be of some synthetic resin or other material. This other material may include, for instance: particles such as aluminum, iron, chromium, zinc, nickel, copper; various metal oxides such as those of iron, aluminum, titanium, or chromium, but also particles of molybdenum sulphide, SiC, graphite, diamond, carborundum and $SiO_2$.

The positive charge on all the above-mentioned particles is generally obtained by the use of a surface active compound in combination or not with a nonionic compound of the same type. For the amounts to be used thereof it is possible in principle to use the same criteria as indicated above for the suspending of resin particles in the first electroplating bath.

It should be added that when use is made of resins of the fluorocarbon type or of graphite fluoride, it is absolutely necessary that fluorocarbon surfactants should be used in order to obtain a dispersion of sufficiently fine particles.

In the process according to the invention, the percentage of resin compounds which is deposited from the first electroplating bath varies from a few percent by volume to not more than about 73 percent by volume. The number of particles that will be deposited per liter of bath liquid will increase with decreasing particle size. It will not be difficult for a man skilled in the art to choose the appropriate conditions for obtaining the desired volume percentage of resinous particles.

The thickness of the porous layer of resinous particles which is formed in the first electroplating bath will continuously increase with the thickness of the composite underlying layer of metal and resin particles.

The composite layer and the porous layer are formed substantially simultaneously. The thickness of the porous layer will continuously increase with the thickness of the underlying layer. Two coating layers are formed in one electroplating step. Just as mentioned above with respect to the percentage resinous compounds that can be incorporated into the metal coating when use is made of the process according to the invention, the thickness of the porous layer is dependent on the size and the amount of the resin particles in the bath liquid.

Of additional importance are cell voltage, agitation of the bath, and the type of metal deposited from the first electroplating bath. Of great importance is also the structure of the surface active substance. It has already been mentioned that this surfactant must not be of the fluorocarbon type, as is the case with the compound in Example V of said Netherlands Patent Application 7,203,718. By surface active compounds of the fluorocarbon type are to be understood here surface active compounds which are capable of wetting the surface of polyfluorocarbon compounds such as polytetrafluoroethylene. They will generally contain 4, and preferably 6 to 10, completely fluoridized carbon atoms.

A compound suitable for use in the process according to the invention has the following structure:

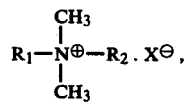

wherein $R_1$ is an alkyl radical having 6 to 20 carbon atoms and $R_2$ is benzyl or an alkyl radical having 1 to 10 carbon atoms, and X represents an anion which does not affect the electroplating bath, such as a $Cl^-$, $SO_4^{2-}$ or $CH_3SO_4^-$ ion. A known compound of the above structure is cetyl trimethyl ammonium bromide (CTAB). Surprisingly, however, it has been found that the thickness of the porous layer considerably increases if for the cationic surface active compound there is used a compound giving up a proton in an aqueous medium. It has been found that the presence of a

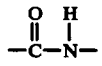

group favorably influences both the quality of the composite coating deposited from the electroplating bath and the thickness of the porous layer. Preference, however, is given to the presence of a

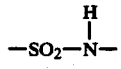

group, by which excellent results are obtained.

As an example of a suitable group of cationic surface active compounds may be mentioned:

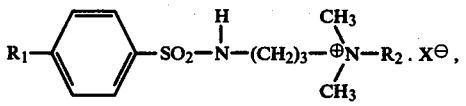

where $R_1$ is H or an alkyl group with 1 to 20 carbon atoms and $R_2$ is benzyl or an alkyl group with 1 to 20 carbon atoms, and X represents an anion which does not affect the electroplating bath, such as a $Cl^-$, $SO_4^{2-}$ or $CH_3SO_4^-$ ion. As a rule, the best results will be obtained if the hydrophobic part of particularly the cationic wetting agent is structurally related to the substance to be wetted.

Very much importance must be attached to a strong adsorption of the wetting agent on the resin particles. In the case where the resin has a predominantly olefinic character very good results are obtained if use is made of a compound having the following structure:

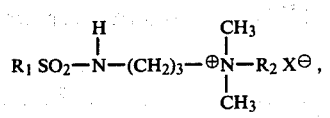

wherein $R_1$ is a straight-chain alkylgroup containing 6 to 20 carbon atoms and $R_2$ represents a benzyl group or an alkyl group having 1 to 10 carbon atoms, and X represents an anion which does not affect the electroplating bath, such as a $Cl^-$, $SO_4^{2-}$ or $CH_3SO_4^-$ ion. The structure of the nonionic wetting agents, too, can only function optimally if the hydrophobic part is structurally related to the substance to be wetted.

They generally contain 2 or more ethylene oxide groups. Examples of nonionic wetting agents are the condensation products of octyl phenol and ethylene oxide (marketed by Rohm & Haas under the trade name Triton X-100) of nonyl phenol and ethylene oxide (marketed by Servo and Akzo Chemie under the trade names NOP 9 and Kyolox NO 90, respectively) and of lauryl alcohol and ethylene oxide.

Although the process according to the invention generally gives good results, it has yet been found that with some molar ratios the stability of the first electroplating bath is not quite satisfactory. The invention therefore provides a process in which the molar ratio between the cationic and the nonionic surface active compounds is chosen between 10:1 and 6:1, and is preferably of the order of 8:1.

It has further been found that optimum results may be obtained if the total amount of wetting agents is approximately $25\times10^{-3}$ mmoles per $m^2$ of particle surface area of the resin compounds. The percentage nonionic surfactants should be strictly within the limits indicated. If the cationic and the nonionic surfactants are used in a molar ratio higher than 100:1, then the quality of the coatings will quickly drop to the level at which agglomeration occurs. Agglomeration will also take place at a ratio smaller than 2:1, as a result of which and because of a smaller charge on the particles, the extent to which they are incorporated is very much reduced.

Under some circumstances, it may be desirable that in the electroplating bath there should also be introduced a stress reducing agent such as p-toluene sulphonamide or saccharin.

As examples of suitable resins that may be incorporated into the coating obtained in the process according to the invention may be mentioned: polyethylene, polypropylene, polyesters, polyacrylates, polyamides, polyimides, aromatic polyamides and polyurethanes with capped or non-capped reactive groups. In principle, all resins can be used that can be formed into small particles of $\leqq 10$ μm, that can be properly wetted by appropriate wetting agents, and that are chemically inert under the electroplating conditions.

Of all these resins the properties may be changed by incorporating into them for instance: pigments, colorants, soluble chemical compounds, compounds with capped or non-capped reactive terminal groups, inhibitors, dispersion agents, and the like.

The diameter of the resinous particles is generally not more than 10 μm, and the thickness of the composite metal/resin coating obtained in the first electroplating bath is in the order of magnitude of 5 to 125 μm, but there may be variations either way. The most favorable results are obtained with the use of resin particles whose diameter does not exceed 5 μm.

Not only the type of wetting agent but also the particle size is of great influence on the thickness of the porous layer formed in the first electroplating bath.

The use of a very fine resin dispersion generally leads to a relatively thick porous layer.

Applying a metal coating according to the invention to a light-weight metal such as aluminum may, for instance, comprise the successive steps of first depositing a zinc coating in the known manner and subsequently, while using a low current density, depositing a nickel coating, followed by a deposition of the combination of nickel and resin particles at a considerably higher current density. Finally, the metal to be contained in the coating may be deposited from an electroplating bath of a different composition.

Further, it is generally very much recommended that prior to the codeposition of nickel and resin particles a pre-nickel plating treatment should be carried out.

In view of its disturbing effect on the electroplating bath containing the resin particles, preferably the presence of iron is avoided.

In the process according to the invention, use may be made of commonly employed electroplating baths, as for instance the sulphamate bath, which makes it possible to attain a high current density, which in its turn leads to a rapid growth of the coating. Moreover, in that case only a relatively low concentration of resinous particles in the bath is needed to obtain a sufficiently high resin concentration in the coating.

Preference, is however given to a Watt's bath.

Not only the composition of the bath but also the temperature at which the electrolysis is carried out plays an important role in obtaining optimum results.

The most favorable temperature is very much dependent on other conditions, but it will not be difficult for a man skilled in the art to establish empirically for a given concentration the temperature at which the most favorable results are obtained.

In the process according to the invention, the current density is generally in the range of 1 to 5 A/dm2. Variations either way are possible, however. The percentage by volume of resinous particles to be incorporated into the composite metal coatings is dependent on several variables.

A further variation of the process according to the invention is characterized in that prior to the sintering treatment, the coating is impregnated with a suspension of solid particles measuring not more than 10 μm in diameter and preferably less than 1 μm in diameter. The material of the solid particles may be metal or metal oxides of aluminum, iron, chromium, titanium, or it may be of silicium carbide, graphite, graphite fluoride, silicium oxide, diamond, molybdenum sulphide, carborundum.

In another variation of the process according to the invention, also a metal salt is incorporated into the coating and under such conditions that the metal salt hydrolyzes in the pores of the coating. If in the case where a sintering treatment is employed, the resin is a polymer with capped or non-capped functional groups, then it is recommended that priot to the sintering treatment there should be incorporated a different material reacting with the groups. The invention relates to objects which are partially or entirely provided with a coating applied to them by a process according to the invention.

The present invention also provides a metal plating bath which contains an aqueous solution of a metal or metals to be electroplated, and a dispersion of fine resin particles which are not formed by a polyfluorocarbon compound and have an average diameter of less than about 10 μm and are used in a concentration of about 3 to 250 grams per liter of bath liquid, and a cationic and a nonionic surface active compound which are not of the fluorocarbon type and are used in a molar ratio between 100:1 and 2:1 and in an amount which is at least $4\times10^{-3}$ mmoles per $m^2$ of surface area of the resin particles.

The invention will be further described in the following examples. The pH of the electroplating baths used in these examples was always between 3.5 and 5. Unless otherwise stated, all baths contained 5 g of boric acid per liter of bath liquid.

EXAMPLE I

A Watt's aqueous nickel plating bath was prepared using the following materials:

| | g/l |
|---|---|
| $NiSO_4 . 6H_2O$ | 130 |
| $NiCl_2 . 6H_2O$ | 40 |
| $H_3BO_3$ | 18 |
| polyamide* | 50 |
| cationic wetting agent** | 2.75 (=0.103 mmoles/g) |
| nonionic wetting agent*** | 0.75 (=0.017 mmoles/g) |

The *polyamide was composed of a number of structural units in accordance with the following formula:

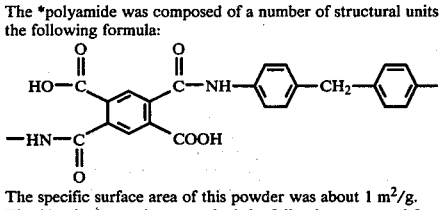

The specific surface area of this powder was about 1 $m^2/g$.
The **cationic wetting agent had the following structural formula:

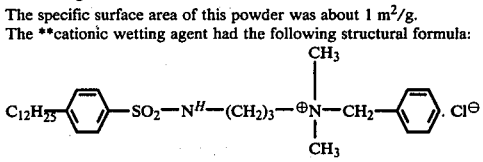

The ***nonionic wetting agent was a condensation product of nonyl phenol and 15 ethylene oxide groups, marketed by Servo under the trade name NOP 15.

The molar ratio between these two types of wetting agents was 6:1. The pH of the bath was 4.6 and the temperature was 45° C. The electrolysis lasted about 1 hour at a current density of 2 $A/dm^2$. The anode consisted of a plate-shaped nickel electrode, and the cathode was formed by a stainless steel tube. This tube had first been cleaned by blasting and degreasing and subsequently activated in a 20% sulphuric acid solution. Two layers were formed. The first layer was composed of nickel and polyamide (18% by volume). Onto it there was deposited a porous polyamide layer in an amount of 12 $g/m^2$. Subsequently, the object was rinsed in water, dried, and then sintered at a temperature of 350° C. In this way, a very satisfactorily bonded, homogeneous coating was obtained.

EXAMPLE II

The procedure of Example I was repeated, but without carrying out the sintering treatment. After the formation of the two layers as in Example I (a first layer of nickel and 18% by volume of polyamide, and a second, porous layer of polyamide in an amount of 12 $g/m^2$), the tube was subsequently transferred to an aqueous nickel sulphamate bath of the following composition:

| | g/l |
|---|---|
| $Ni(NH_2SO_3)_2$ | 465 |
| $NiCl_2 . 6H_2O$ | 5 |
| $H_3BO_3$ | 45 |

The pH of the bath was 4 and the temperature was 50° C. After about 1 hour the porous layer was found to be entirely filled up with nickel. This second nickel coating contained 16% by volume of polyamide. The current density was 2 $A/dm^2$.

EXAMPLE III

In the same way as indicated in Example I, a stainless steel tube was treated in a Watt's nickel plating bath of the same composition except that the resin was a powder known under the trade name Monsanto RJ 100, consisting of a copolymer of styrene and allyl alcohol with a molecular weight of 1600, a melting point of 100° C., and an acid number of 0.5. The specific surface area of this powder was 3.4 $m^2/g$.

As cationic wetting agent a compound having the following structural formula was used:

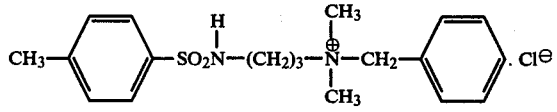

in a concentration of 2 g/liter of bath liquid, which corresponds to $31\times10^{-3}$ mmoles/$m^2$ polymer. The nonionic wetting agent was a ricinus oil with 15 ethylene oxide groups in an amount of 10 mg/gram of the polymer Monsanto RJ 100, which corresponds to $3.07\times10^{-3}$ mmoles/$m^2$. So the molar ratio between the two types of wetting agents was 10:1. Two layers were formed. The first contained 26% by volume of the resin. The second, porous layer bonded to it had a weight of 8 $g/m^2$.

EXAMPLE IV

An aqueous zinc bath was prepared using the following materials:

| | g/l |
|---|---|
| $Zn SO_4 . 7H_2O$ | 55 |
| $Zn Cl_2$ | 10 |
| $H_3BO_3$ | 2.5 |
| polyamide (as in Example I) | 40 |
| cationic wetting agent (as in Example I) | 1.6 (=0.075 mmoles/g) |
| nonionic wetting agent (as in Example I) | 0.4 (=0.011 mmoles/g) |

So the molar ratio between the cationic wetting agent and the nonionic wetting agent was 7.

The pH of the bath was 4.8 and the temperature 20° C. The electrolysis lasted 1 hour and the current density was 6 $A/dm^2$. The anode was a zinc plate, and the cathode was formed by a stainless steel tube. On the surface of the cathode there was formed a composite coating containing 18% by volume of polyamide. The porous layer of polyamide bonded to it had a weight of 7.8 $g/m^2$.

EXAMPLE V

Another aqueous zinc bath was prepared using the following materials:

| | g/l |
|---|---|
| $Zn\,SO_4 \cdot 7H_2O$ | 110 |
| $Zn\,Cl_2$ | 20 |
| $H_3BO_3$ | 5 |
| Monsanto RJ 100 (see Example III) | 100 |
| cationic wetting agent (as in Example III) | 4 (=31 × $10^{-3}$ mmoles/$m^2$) |
| nonionic wetting agent (as in Example III) | 1 (=3.07 × $10^{-3}$ mmoles/$m^2$) |

As in Example III, the molar ratio between the cationic surfactant and the nonionic surfactant was 10:1.

The pH of the bath was 4.6 and the temperature 20° C. The electrolysis lasted 1 hour and the current density was 6 A/$dm^2$. The anode consisted of a zinc plate, and the cathode was formed by a stainless steel tube.

On the cathode there was formed a composite coating 11% by volume of the resin used. The porous layer bonded to it had a weight of 11 g/$m^2$.

EXAMPLE VI

The procedure of Example V was repeated, except that for the cationic wetting agent use made of cetyl trimethyl ammonium bromide in an amount which corresponds to $40\times10^{-3}$ mmoles/$m^2$ of the polymer RJ 100, which was employed in powdered form and in a concentration of 40 g/l. Here, too, the nonionic wetting agent was prepared from NOP 15 in an amount which corresponds to $5\times10^{-3}$ mmoles/$m^2$ polymer. The molar ratio of cationic wetting agent to nonionic wetting agent was 8:1. The current density was 1 A/$dm^2$ for 1 hour.

On the cathode there formed a composite layer which contained the resin in an amount of 30 percent by volume. The porous layer bonded to it had a weight of 4 g/$m^2$.

EXAMPLE VII

The procedure of Example VI was repeated in such a way that per $m^2$ of polymer use was made of $23\times10^{-3}$ mmoles of a cationic wetting agent having the following formula:

$$C_{16}H_{33}SO_2\overset{H}{\overset{|}{N}}(CH_2)_3 \cdot \overset{\oplus}{N}(CH_3)_3 \cdot CH_3OSO_3^{\ominus}$$

About $3\times10^{-3}$ mmoles of ethoxylated ricinus oil per $m^2$ of polymer was used as the nonionic wetting agent. The molar ratio between the two types of wetting agents was about 8:1. The bath also contained 1 g of thiourea and 1 g of glycerol per liter of bath liquid. The electrolysis lasted 2 hours at a current density of 1 A/$dm^2$. A composite coating which contained the employed polymer in an amount of 33 percent by volume formed on the cathode. The porous layer bonded to it had a weight of 33 g/$m^2$. After the coated object had been rinsed in clean water, it was subjected to a second electrolysis treatment in a different bath which, however, did not contain a resin dispersion. Upon analysis it was found that the second coating contained about 31 percent by volume of resin.

EXAMPLE VIII

The procedure described in Example VII was repeated in such a way that per $m^2$ of polymer surface area use was made of $25.6\times10^{-3}$ mmoles of a cationic wetting agent having the following formula:

$$C_{12}H_{25}SO_2\overset{H}{\overset{|}{N}}(CH_2)_3\overset{\oplus}{N}(CH_3)_3 \cdot CH_3OSO_3^{\ominus}$$

About $3.1\times10^{-3}$ mmoles of ethoxylated ricinus oil per $m^2$ of polymer surface area was used as the nonionic wetting agent. The polymer concentration was 50 g/l and the current density 2 A/$dm^2$. After 1 hour's electrolysis there had formed a composite layer which contained 28 percent by volume of resin. The porous layer bonded to it had a weight of 91 g/$m^2$.

EXAMPLE IX

The procedure of Example VIII was repeated, except that per liter of bath liquid use was made of 30 g of the polyamide used in Example I. The cationic wetting agent was the same as the one used in Example VIII. It was employed in an amount of 40 mg/g polymer corresponding to 0.087 mmoles/g polymer. For the nonionic wetting agent, again ethoxylated ricinus oil was used in an amount of 10 mg/g or about 0.01 mmole/g of polymer.

The electrolysis lasted 2 hours at a current density of 1 A/$dm^2$ and a bath temperature between 20° C. and 25° C.

The composite coating contained 21 percent by volume of resin. The porous layer bonded to it had a weight of 4.4 g/$m^2$.

EXAMPLE X

The experiment of Example IX was repeated in such a way that use was made of an electroplating bath containing per liter of bath liquid 50 grams of powdered polyimide having the following structural formula:

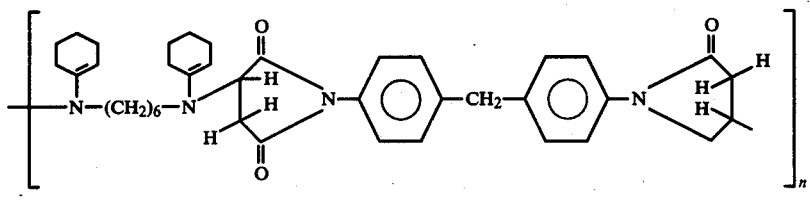

The specific surface area of this powder was 16 $m^2$/g. The resulting composite coating contained 18 percent by volume of said polyimide. The porous layer bonded to it had a weight of 15 grams/$m^2$.

EXAMPLE XI

An aqueous zinc plating bath was prepared having the following composition:

| | g/l |
|---|---|
| $ZnSO_4 . 7H_2O$ | 110 |
| $ZnCl_2$ | 20 |
| $H_3BO_3$ | 5 |

Into this bath there was introduced a dispersion of polyethylene terephthalate in a concentration of 60 g per liter of bath liquid and having a specific surface area of about 12.3 $m^2/g$. The PETP powder was wetted with 2100 mg of a cationic wetting agent having the formula $$C_{12}H_{25}SO_2\overset{H}{\overset{|}{N}}(CH_2)_3\overset{\oplus}{N}(CH_3)_3 . Cl^{\ominus},$$

which corresponds to $6.3\times10^{-3}$ mmoles/$m^2$.

As nonionic wetting agent there were used 900 mg of ethoxylated ricinus oil, which corresponds to about $1.2\times10^{-3}$ mmoles/$m^2$. The molar ratio of cationic wetting agent to nonionic wetting agent was about 5. The electrolysis lasted 1.5 hours at a current density of 1 A/$dm^2$ and a bath temperature of about 20° to 25° C. The resulting composite metal-polyester coating contained 44 percent by volume of PETP. The layer of polyester powder bonded to it had a weight of 6 g/$m^2$.

EXAMPLE XII (comparative example)

An aqueous nickel sulphamate bath was prepared having the following composition:

| | concentration g/l |
|---|---|
| $Ni(NH_2SO_3)_2$ | 465 |
| $NiCl_2$ | 5 |
| $H_3BO_3$ | 40 |

Use was made of the same polymer particles as in Example XI with the exception that instead of a PETP-concentration of 60 g/l of bath liquid a concentration of 50 g/l was used.

The PETP-powder was wetted with a cationic wetting agent of the fluorocarbon type according to the formula $$C_8F_{17}SO_2\overset{H}{\overset{|}{N}}-(CH_2)_3N^{\oplus}(CH_3)_3I^{\ominus}$$

marketed by Minnesota Mining & Manufacturing Company under the trade name FC 134, in a concentration of 100 mg/l, corresponding to $1.6\times10^{-4}$ mmoles/$m^2$.

As nonionic surfactant there was used a condensation product of nonyl phenol and ethylene oxide, marketed under the trade name of NOP 9 by Servo, in a concentration of 100 mg/l, corresponding to $1.6\times10^{-4}$ mmoles/$m^2$.

The temperature of the bath was 50° C. The mean current density was 7 A/$dm^2$. Though a reasonable amount of polyester was incorporated, both the quality of the composite nickel-PETP layer and the stability of the dispersion were far from satisfactory.

EXAMPLE XIII

The procedure of Example VIII was repeated, except that use was made of a powder consisting of an urea-formaldehyde resin, marketed by CIBA Geigy under the trade name Pergopak M. The specific surface area of this powder was 14 $m^2/g$. As cationic wetting agent there were used about $6.4\times10^{-3}$ mmoles per $m^2$ of polymer. The molar ratio between the two types of wetting agents was about 8:1. The electrolysis lasted 2 hours at a current density of 1 A/$dm^2$. On the cathode there was formed a composite coating which contained the employed polymer in an amount of 12 percent by volume. The porous layer bonded to it had a weight of 9 g/$m^2$.

EXAMPLE XIV

The procedure of Example XIII was repeated, except that the resin was a polyethylene powder marketed by Hoechst under the trade name Ceridust V.P. 590. The specific surface area of this powder was 24 $m^2/g$. As cationic wetting agent there were used about $3.7\times10^{-3}$ mmoles per $m^2$ of polymer. The molar ratio between the two types of wetting agents was about 7.5:1. The electrolysis lasted 2 hours at a current density of 1 A/$dm^2$. On the cathode there was formed a composite coating which contained the employed polymer in an amount of 16 percent by volume. The porous layer bonded to it had a weight of 10 g/$m^2$.

EXAMPLE XV

A copper bath was prepared using the following composition ingredients:

| | |
|---|---|
| $CuSO_4 . 5H_2O$ | 200 g/l |
| NaCl | 150 mg/l |
| $H_2SO_4$ in an amount to obtain a pH = 1 | |
| Monsanto RJ 100 (as in Example III) | 50 g/l |
| Cationic wetting agent (as in Example VIII) | $25.6\times10^{-3}$ mmoles/ $m^2$ polymer |
| Nonionic wetting agent (as in Example VIII) | $3.1\times10^{-3}$ mmoles $m^2$ polymer. |

The molar ratio between the cationic surfactant and the nonionic surfactant was about 8:1.

The electrolysis lasted 1 hour and the current density was 2 A/$dm^2$. On the cathode there was formed a composite layer which contained 43% by volume of the resin used. The porous layer bonded to it had a weight of 12 g/$m^2$.

EXAMPLE XVI

A cobalt bath was prepared using the following composition ingredients:

| | |
|---|---|
| $CoSO_4 . 7H_2O$ | 350 g/l |
| $CoCl_2$ | 50 g/l |
| $H_3BO_3$ | 20 g/l |
| The pH of the bath was 3.5 and the temperature 25° C. | |
| Cationic wetting aagent (as in Example VIII) | $25.6\times10^{-3}$ mmoles/ $m^2$ polymer. |
| Nonionic wetting agent (as in Example VIII) | $3.1\times10^{-3}$ mmoles/ $m^2$ polymer. |

The electrolysis lasted ½ hour and the current density was 4 A/$dm^2$.

On the cathode there was formed a composite layer which contained 58% by volume of the resin used. The porous layer bonded to it had a weight of 30 g/m$^2$.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A process for coating a substrate which comprises codepositing on a substrate serving as a cathode a metal and resin particles having an average particle size of less than about 10 $\mu$m from an electroplating bath containing the said resin particles in a concentration of about 3 to 250 g per liter of bath liquid in the presence of both a cationic and a nonionic surface active compound for wetting said resin particles in a molar ratio between 100:1 and 2:1 and in an amount which is at least $4\times10^{-3}$ mmoles per m$^2$ of the surface area of the particles, said surface active compounds containing no completely fluoridized carbon atoms, and thereafter drying the coating, said resin particles being other than a polyfluorocarbon compound.

2. A process according to claim 1 wherein the resulting coating is subjected to any one of the following three treatments: curing or sintering or melting.

3. A process according to claim 2 wherein prior to the sintering treatment the coating is impregnated with a suspension of solid particles having an average particle size of not more than 10 $\mu$m.

4. A process according to claim 1 wherein the molar ratio between the cationic and the nonionic surface active compound is between 10:1 and 6:1.

5. A process according to claim 1 wherein the total amount of wetting agents is about $25\times10^{-3}$ mmoles per m$^2$ of surface area of the resin compounds.

6. A process according to claim 1 wherein the cationic surface active substance is a compound of the following structure:

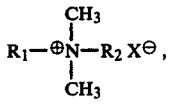

where $R_1$ is an alkyl group with 6 to 20 carbon atoms and $R_2$ is a benzyl or an alkyl group containing 1 to 10 carbon atoms, and X represents an anion inert to the electroplating bath.

7. A process according to claim 1 wherein the cationic surface active compound is capable of giving up a proton in an aqueous medium.

8. A process according to claim 7, wherein the cationic wetting agent is a compound with an

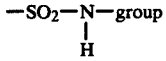

9. A process according to claim 8, wherein the cationic wetting agent is a compound having the following structure:

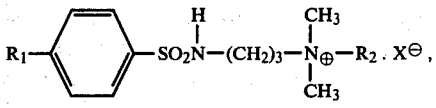

wherein $R_1$ is H or an alkyl group with 1 to 20 carbon atoms and $R_2$ is benzyl or an alkyl group with 1 to 10 carbon atoms, and X represents an anion inert to the electroplating bath.

10. A process according to claim 8, wherein the cationic wetting agent is a compound having the following structure:

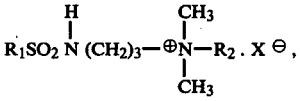

wherein $R_1$ is an alkyl group with 6 to 20 carbon atoms and $R_2$ is a benzyl or an alkyl group with 1 to 10 carbon atoms, and X represents an anion which is inert to the electroplating bath.

11. A process for applying to an object a coating composed of a resin which is not formed by a polyfluorocarbon compound, and a metal which comprises codepositing onto an article acting as a cathode from an electroplating bath a metal and resin particles having an average size of less than about 10 $\mu$m in a concentration of about 3 to 250 grams per liter of bath liquid in the presence of both a cationic and nonionic surface active compound for wetting said resin particles in a molar ratio between 100:1 and 2:1 and in an amount which is at least $4\times10^{-3}$ mmoles per m$^2$ of surface area of the resin particles, said surface active compounds containing no completely fluoridized carbon atoms, and depositing onto the resulting coating serving as a cathode from an electroplating bath of a different composition a metal and particles of a different material.

12. An electroplating bath which contains an aqueous solution of a metal or metals to be electroplated and a dispersion of fine resin particles which are formed from compounds other than a fluorocarbon compound and have an average diameter of less than about 10 $\mu$m, the concentration thereof being about 3 to 250 grams per liter of bath liquid, and both a cationic surface active compound and a nonionic surface active compound for wetting said resin particles in a molar ratio between 100:1 and 2:1 and in an amount which is at least $4\times10^{-3}$ mmoles per m$^2$ of surface area of the resin particles, said surface active compounds containing no completely fluoridized carbon atoms.

13. An electroplating bath according to claim 12, wherein the molar ratio between the cationic and nonionic surface active agents is between 10:1 and 6:1.

14. An electroplating bath according to claim 12 wherein the amount of surface active compounds is about $25\times10^{-3}$ mmoles per m$^2$ of surface area of the polymer particles.

15. A process for simultaneously coating an article with a metal and a synthetic resin which comprises making the article the cathode in an aqueous electroplating bath which contains (1) a salt of a metal to be electroplated, and (2) particles of a synthetic resin, the concentration of said particles being from about 3 to about 250 grams per liter of bath, the particle size of the resin being less than about 10 $\mu$m, (3) a cationic surfactant and (4) a nonionic surfactant for wetting said resin particles, the ratio of (3) to (4) being between 100:1 and 2:1, the concentration of (3) and (4) in the bath being at least $4\times10^{-3}$ mmoles per $m^2$ of surface area of the said particles and subjecting the bath to electrolysis until a layer of metal and resin is applied on the surface of the article and a resinous coating is deposited substantially simultaneously over the said layer, said resinous particles being free from fluorocarbon groups and the said surfactants containing no completely fluoridized carbon atoms.

16. A process according to claim 15 wherein the resulting coating is dried, and subjected to any one of the following three treatments: curing or sintering or melting.

17. A process for applying to an object a coating composed of a resin which is not formed by a polyfluorocarbon compound, and a metal which comprises codepositing onto an article acting as a cathode from an electroplating bath a metal and resin particles having an average size of less than about 10 μm in a concentration of about 3 to 250 grams per liter of bath liquid in the presence of both a cationic and nonionic surface active compound for wetting said resin particles in a molar ratio between 100:1 and 2:1 and in an amount which is at least $4\times10^{-3}$ mmoles per $m^2$ of surface area of the resin particles, said surface active compounds containing no completely fluoridized carbon atoms, and depositing onto the resulting coating serving as a cathode from an electroplating bath of a different composition a metal.

* * * * *